US012134847B2

(12) United States Patent
Haglund et al.

(10) Patent No.: US 12,134,847 B2
(45) Date of Patent: Nov. 5, 2024

(54) APPARATUSES INCLUDING SUPPORT AND ACCESSORY ARMS FOR POSITIONING A SEWING MACHINE ACCESSORY

(71) Applicant: Singer Sourcing Limited LLC, Lavergne, TN (US)

(72) Inventors: Ida Maria Haglund, Habo (SE); Sofia Lovisa Elisabeth Rudstam, Habo (SE); Sara N. J. Thorén, Jonkoping (SE); Marcus Petter Svensson, Jönköping (SE)

(73) Assignee: Singer Sourcing Limited LLC, Nashville, TN (US)

( * ) Notice: Subject to any disclaimer, the term of this patent is extended or adjusted under 35 U.S.C. 154(b) by 152 days.

(21) Appl. No.: 17/890,341

(22) Filed: Aug. 18, 2022

(65) Prior Publication Data

US 2024/0060224 A1 Feb. 22, 2024

(51) Int. Cl.

| | |
|---|---|
| ***D05B 81/00*** | (2006.01) |
| ***D05B 79/00*** | (2006.01) |
| ***D05B 87/04*** | (2006.01) |

(52) U.S. Cl.

CPC ..... *D05B 81/00* (2013.01); *D05B 79/00* (2013.01); *D05B 87/04* (2013.01)

(58) Field of Classification Search

CPC ..... D05B 79/00; D05B 81/00; D05B 83/00; D05C 13/00

See application file for complete search history.

(56) References Cited

U.S. PATENT DOCUMENTS 576,165 A * 2/1897 Shelverton ..... B60R 1/06 248/479
1,059,868 A 4/1913 Harrison
(Continued)

FOREIGN PATENT DOCUMENTS

CN 202936618 U 5/2013
CN 103334243 A 10/2013
(Continued)

OTHER PUBLICATIONS

PCT Search Report and Written Opinion for PCT International Application No. PCT/2023/028795.
(Continued)

*Primary Examiner* — Danny Worrell
(74) *Attorney, Agent, or Firm* — Olive Law Group, PLLC

(57) ABSTRACT

Apparatuses including support and accessory arms for positioning a sewing machine accessory are disclosed. According to an aspect, an apparatus for positioning a sewing machine accessory includes a support arm. The support arm is configured for attachment to a sewing machine and comprises a first coupling component. The first coupling component comprises a first magnetic component. The apparatus also includes an accessory arm configured for attachment of a sewing machine accessory. The accessory arm comprises a second coupling component. The first coupling component and the second coupling component are configured for attachment together. The second coupling component comprises a second magnetic component that is attracted to the first magnetic component for urging the second coupling component towards the first coupling component when the first and second coupling components are attached together. The first and second coupling components are configured to position the sewing machine accessory to a user-determined position.

24 Claims, 6 Drawing Sheets

(56) References Cited

U.S. PATENT DOCUMENTS

| | | | |
|---|---|---|---|
| 1,179,142 | A | 4/1916 | Shaughnessy |
| 1,216,209 | A | 2/1917 | Callahan |
| 1,241,427 | A | 9/1917 | Nielsen |
| 1,256,671 | A | 2/1918 | Flower |
| 1,278,995 | A | 9/1918 | Petro |
| 1,470,890 | A | 10/1923 | Stone |
| 1,567,439 | A | 12/1925 | Heitzler |
| 1,762,809 | A | 6/1930 | Bradford |
| 1,783,278 | A | 12/1930 | Brady |
| 1,806,252 | A | 5/1931 | Hohein |
| 1,806,422 | A | 5/1931 | Shaen |
| 1,971,519 | A | 8/1934 | Bradford |
| 2,104,198 | A | 1/1938 | Jones |
| 2,355,161 | A | 8/1944 | Holstein |
| 2,481,450 | A | 9/1949 | Schwartz |
| 2,732,761 | A | 1/1956 | Werner et al. |
| 2,955,884 | A | 10/1960 | Marshall et al. |
| 3,011,258 | A | 12/1966 | Kotchan |
| 3,361,513 | A | 1/1968 | Pantazos |
| 3,512,875 | A | 5/1970 | Viollet |
| 3,822,088 | A | 7/1974 | Steiner |
| 4,084,216 | A | 4/1978 | Shonting |
| 4,133,603 | A | 1/1979 | Inouye |
| 4,316,330 | A | 2/1982 | Hayes |
| 4,331,381 | A | 5/1982 | Hunter |
| 4,398,800 | A | 8/1983 | Hayes |
| 4,764,958 | A | 8/1988 | Grant |
| 4,885,667 | A | 12/1989 | Selden |
| 4,930,871 | A | 6/1990 | Tannahill |
| 5,311,365 | A | 5/1994 | Klearman et al. |
| 5,345,831 | A | 9/1994 | Sandrock |
| 6,398,087 | B2 | 6/2002 | Solich |
| 6,476,984 | B1 | 11/2002 | Ringdahl |
| 6,717,750 | B2 | 4/2004 | Knipping et al. |
| 8,292,446 | B2 | 10/2012 | Fujihara et al. |
| D740,334 | S | 10/2015 | Moseley |
| 9,395,530 | B2 * | 7/2016 | Yokoyama ..... G02B 25/005 |
| 10,914,079 | B2 | 2/2021 | Deetz |
| 2020/0123687 | A1 | 4/2020 | Gupta |
| 2023/0022958 | A1 * | 1/2023 | Guccione ..... D05B 79/00 |

FOREIGN PATENT DOCUMENTS

| | | | | |
|---|---|---|---|---|
| CN | 204780216 | U | 11/2015 | |
| CN | 211256282 | U | 8/2020 | |
| CN | 216809169 | U | 6/2022 | |
| EP | 2840177 | A1 | 2/2015 | |
| JP | H079279 | U | 1/1995 | |
| JP | 11267388 | A2 | 10/1999 | |
| JP | 3988244 | B2 | 10/2007 | |
| KR | 20110009751 | A * | 1/2011 | ..... D05B 79/00 |
| KR | 2017 0137300 | A | 12/2017 | |
| KR | 101849939 | B1 | 12/2017 | |
| WO | WO-2019149333 | A1 * | 8/2019 | ..... D05B 79/00 |

OTHER PUBLICATIONS

U.S. Pat. No. 879,003 patented Feb. 11, 1908 entitled "Needle Threader" (2 pages).

U.S. Pat. No. 756,024 patented Mar. 29, 1904 entitled "Magnifying Attachment for Sewing Machines" (4 pages).

U.S. Pat. No. 294,171 patented Feb. 26, 1884 entitled "Optical Attachment for Sewing Machies" (3 pages).

* cited by examiner

APPARATUSES INCLUDING SUPPORT AND ACCESSORY ARMS FOR POSITIONING A SEWING MACHINE ACCESSORY

TECHNICAL FIELD

The presently disclosed subject matter relates generally to sewing machines. Particularly, the presently disclosed subject matter relates to apparatuses including support and accessory arms for positioning a sewing machine accessory.

BACKGROUND

Sewing machines are used to sew together materials and fabric together with thread. A typical sewing machine includes an upper body having a needle mechanism, and a lower body having a workspace positioned under the needle mechanism. A presser foot is positioned at the workspace for holding fabric or other materials in place. Once thread is properly guided through the mechanism of the upper body, it is threaded into the needle and the presser foot is lowered to secure the material in place for sewing. Threading of the needle, operation of other components, and turning of the material for sewing requires steady hands and precise movement in the workspace.

One difficulty with sewing is that the sewing machine components, thread, and sewing area are small. As a result, great vision is needed. There have been some efforts to provide magnification to these areas to improve the view given to the operator. However, there is a continuing need for equipment and techniques that provide an improved view of sewing machine components, thread, and sewing area.

BRIEF DESCRIPTION OF THE DRAWINGS

Figure 1:
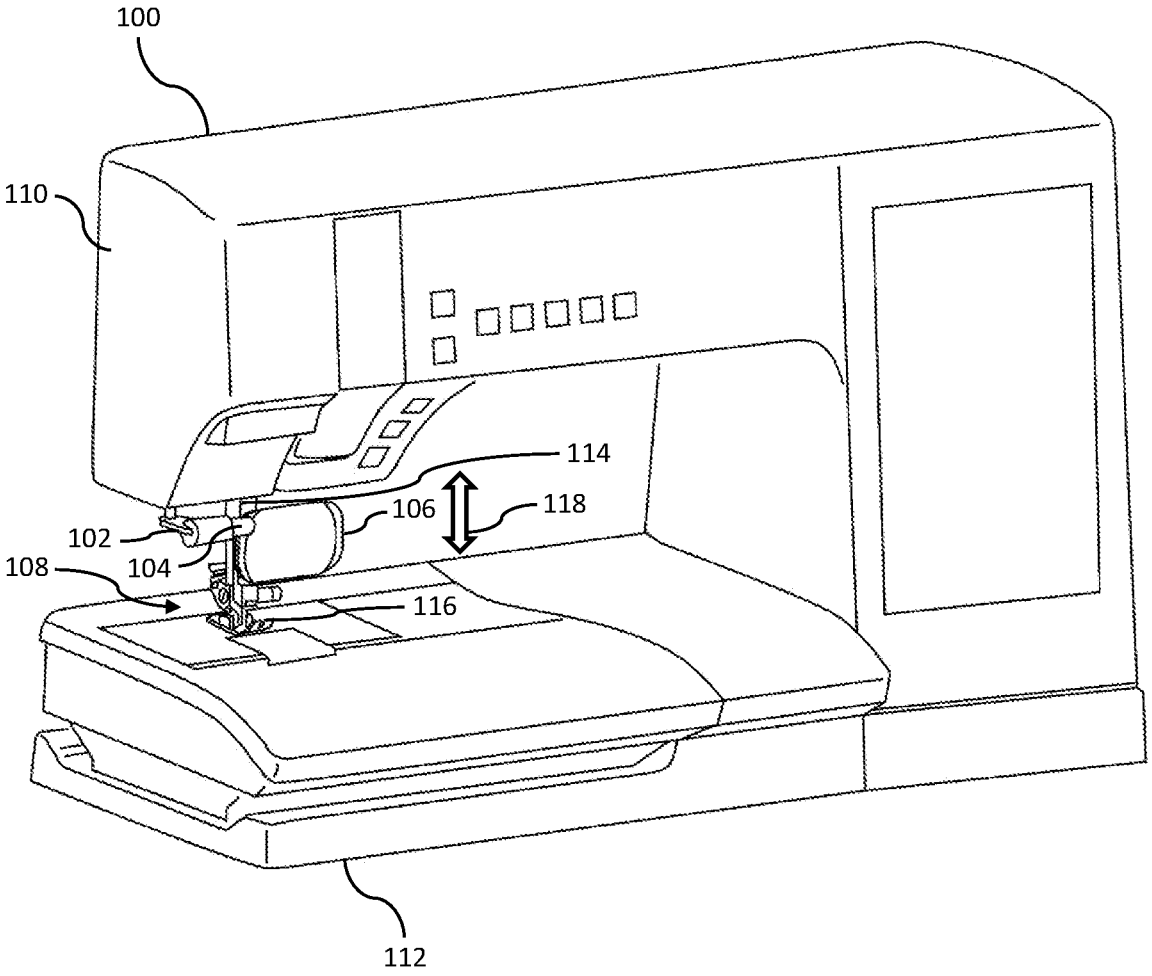
Figure 2A:
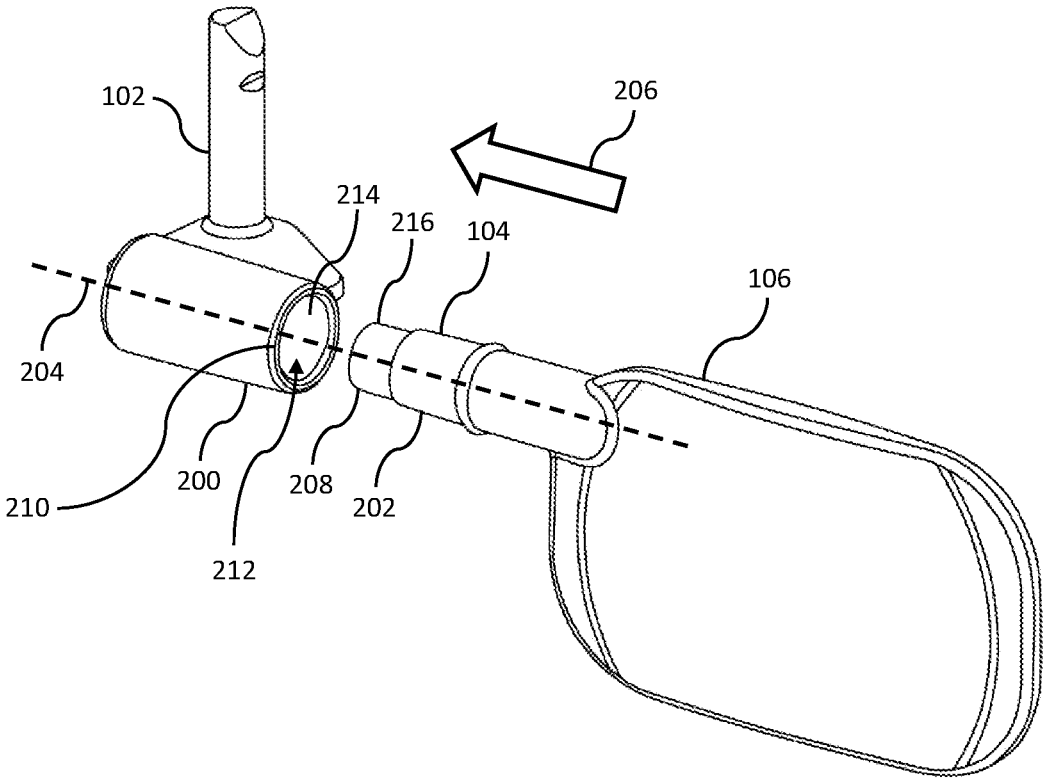
Figure 2B:
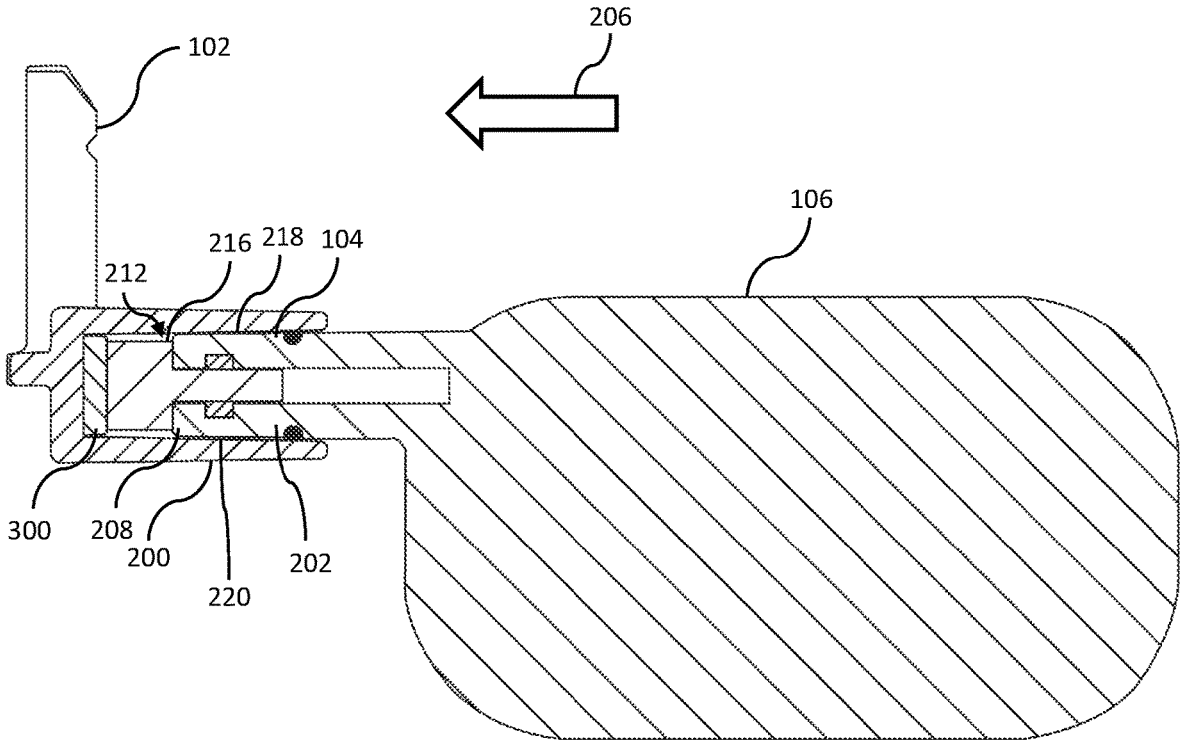
Figure 3:
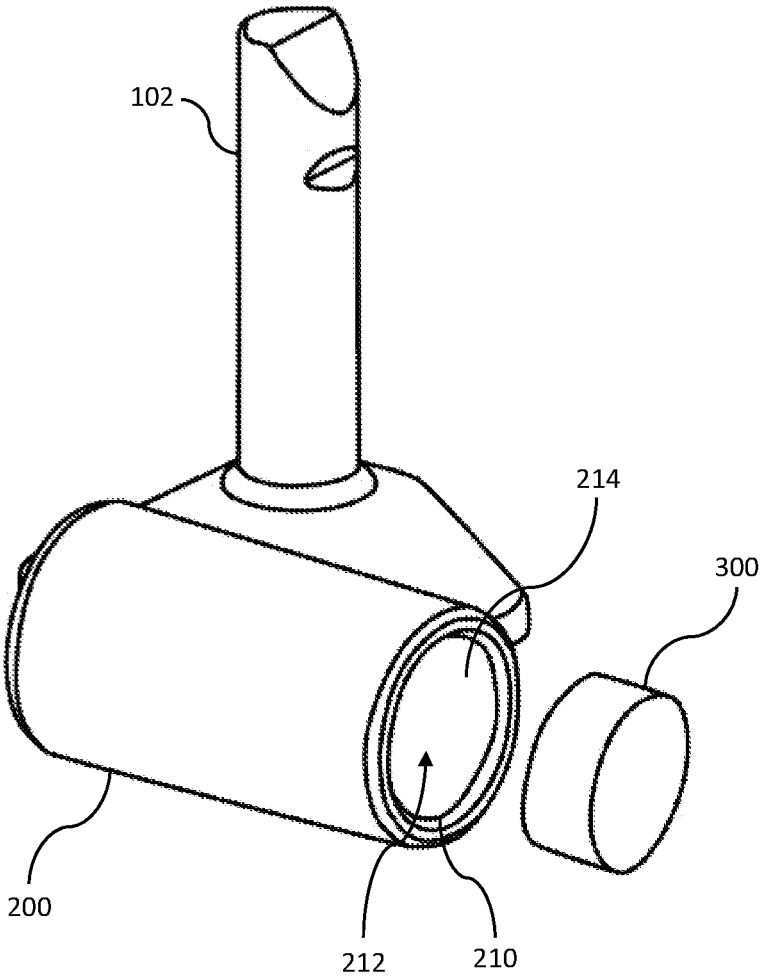
Figure 4:
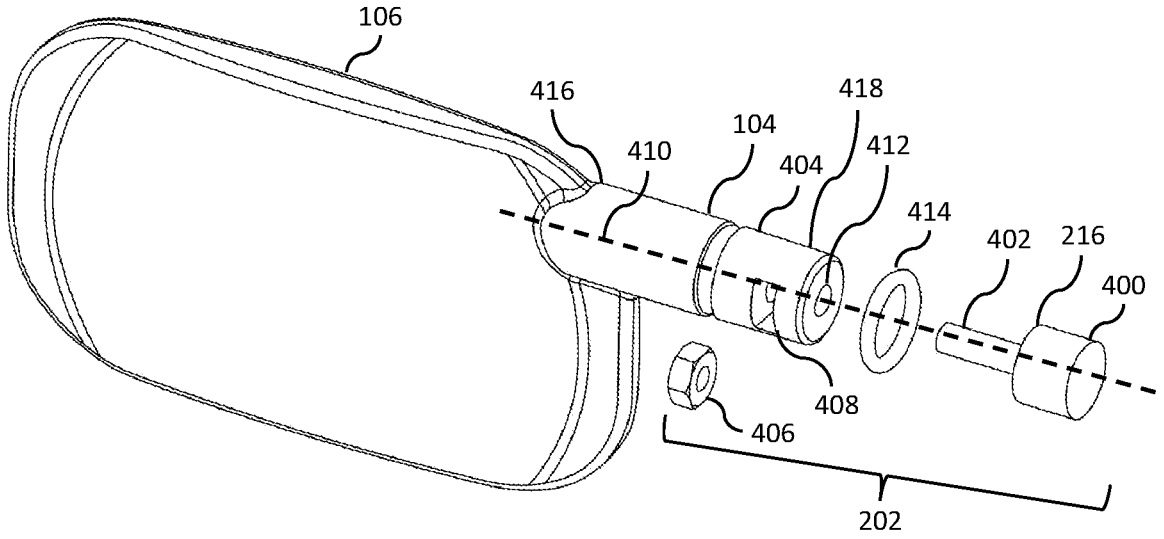
Figure 5B:
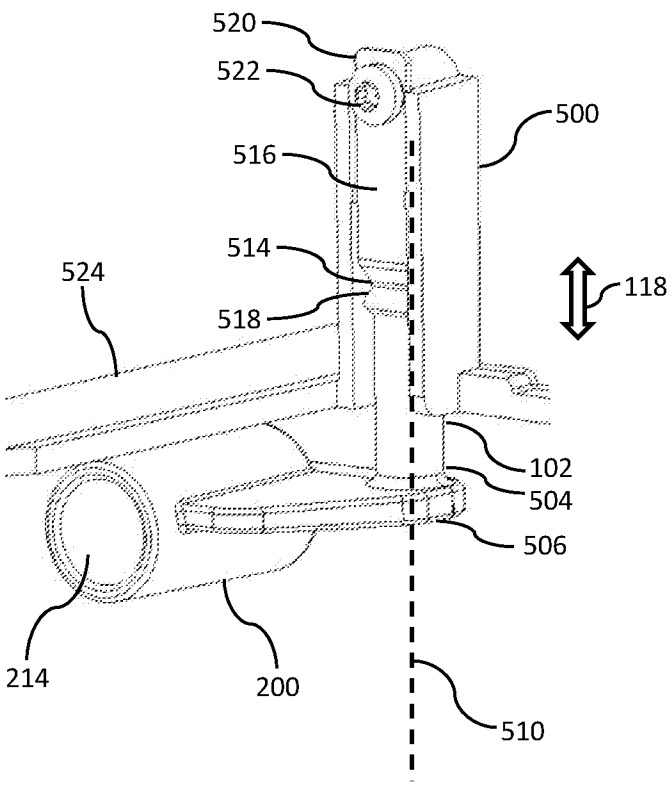
Figure 5A:
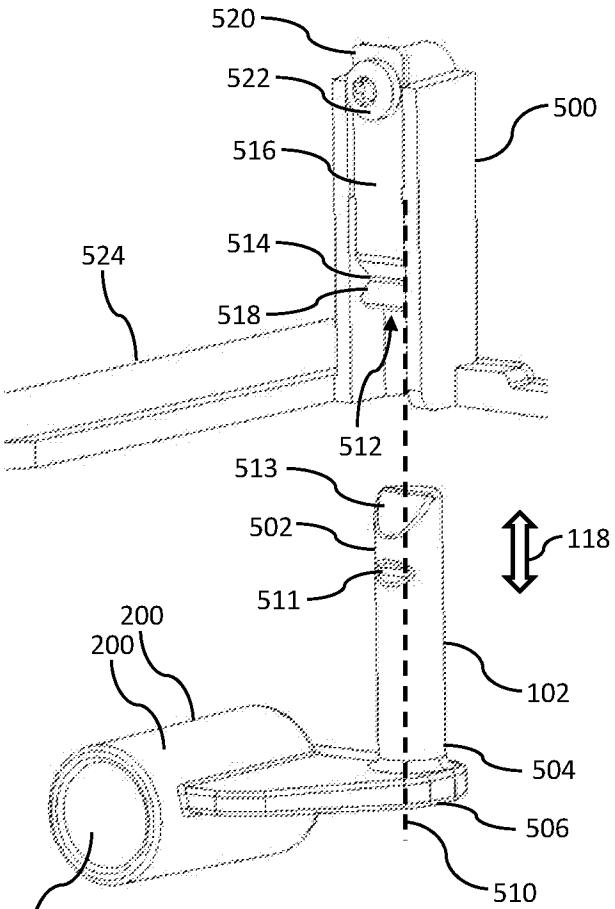

Having thus described the presently disclosed subject matter in general terms, reference will now be made to the accompanying Drawings, which are not necessarily drawn to scale, and wherein:

FIG. 1 is a perspective view of a sewing machine including a support arm and an accessory arm for positioning a sewing machine accessory in accordance with embodiments of the present disclosure;

FIG. 2A is a perspective view of the support arm with the accessory arm being detached therefrom;

FIG. 2B is a cross-sectional, side view of the support arm with the accessory arm being attached;

FIG. 3 is an exploded, perspective view of the support arm with its coupling component's magnetic component being positioned outside of the interior for purpose of illustration;

FIG. 4 is an exploded, perspective view of the accessory arm with the coupling component; and FIGS. 5A and 5B illustrate perspective views of the support arm in a detached position and an attached position, respectively, with respect to an underside of a sewing machine in accordance with embodiments of the present disclosure.

SUMMARY

The presently disclosed subject matter relates to apparatuses including support and accessory arms for positioning a sewing machine accessory. According to an aspect, an apparatus for positioning a sewing machine accessory includes a support arm. The support arm is configured for attachment to a sewing machine and comprises a first coupling component. The first coupling component comprises a first magnetic component. The apparatus also includes an accessory arm configured for attachment of a sewing machine accessory. The accessory arm comprises a second coupling component. The first coupling component and the second coupling component are configured for attachment together. The second coupling component comprises a second magnetic component that is attracted to the first magnetic component for urging the second coupling component towards the first coupling component when the first and second coupling components are attached together. The first and second coupling components are configured to position the sewing machine accessory to a user-determined position when the first and second coupling components are attached together.

In another aspect, the sewing machine accessory comprises a magnifier or a light source.

In another aspect, the sewing machine accessory comprises a magnifier. The first and second coupling components are configured to position and orient the magnifier for magnifying an operator's view of a workspace of the sewing machine.

In another aspect, the second coupling component is rotatable with respect to the first coupling component when the first and second components are attached together.

In another aspect, the first coupling component defines an interior and opening for receipt of a portion of the second coupling component.

In another aspect, the first magnetic component is held within the interior. The second magnetic component is attached to the portion of the second coupling component such that the second magnetic component is positioned within the interior when the first and second coupling components are attached together.

In another aspect, the interior extends along a substantially horizontal direction. The interior defines an upper surface and a lower surface. The portion of the second coupling component engages the upper surface and the lower surface for support of the accessory arm in a vertical direction.

In another aspect, the support arm comprises an upper end and a lower end. The support arm extends along a substantially vertical direction. The upper end is attachable to an underside of the sewing machine. The first coupling component is attached to the lower end.

In another aspect, the support arm is rotatable about the vertical direction.

In another aspect, the accessory arm comprises a first end and a second end. The accessory arm extends along a substantially horizontal direction. The second coupling component is attached to the first end. The second end is attached to the sewing machine accessory.

In another aspect, the accessory arm is rotatable about the horizontal direction.

In another aspect, the first and second magnetic components are substantially aligned with the horizontal direction.

According to another aspect, a sewing machine includes an upper body comprising a needle mechanism. The sewing machine also includes a lower body comprising a workspace positioned under the needle mechanism. Further, the sewing machine includes a support arm attached to the upper body. The support arm comprises a first coupling component. The first coupling component comprises a first magnetic component. The sewing machine also includes an accessory arm attached to a sewing machine accessory. The accessory arm comprises a second coupling component. The first coupling component and the second coupling component are configured for attachment together. The second coupling component comprises a second magnetic component that is attracted to the first magnetic component for urging the second coupling component towards the first coupling component when the first and second coupling components are attached together. The first and second coupling components are configured to position the sewing machine accessory to a user-determined position with respect to the workspace when the first and second coupling components are attached together.

In another aspect, the sewing machine accessory comprises a magnifier or a light source.

In another aspect, the sewing machine accessory comprises a magnifier. The first and second coupling components are configured to position and orient the magnifier for magnifying an operator's view of a workspace of the sewing machine.

In another aspect, the second coupling component is rotatable with respect to the first coupling component when the first and second components are attached together.

In another aspect, the first coupling component defines an interior and opening for receipt of a portion of the second coupling component.

In another aspect, the first magnetic component is held within the interior. The second magnetic component is attached to the portion of the second coupling component such that the second magnetic component is positioned within the interior when the first and second coupling components are attached together.

In another aspect, the interior extends along a substantially horizontal direction. The interior defines an upper surface and a lower surface. The portion of the second coupling component engages the upper surface and the lower surface for support of the accessory arm in a vertical direction.

In another aspect, the support arm comprises an upper end and a lower end. The support arm extends along a substantially vertical direction. The upper end is attachable to an underside of the sewing machine. The first coupling component is attached to the lower end.

In another aspect, the support arm is rotatable about the vertical direction.

In another aspect, the accessory arm comprises a first end and a second end. The accessory arm extends along a substantially horizontal direction. The second coupling component is attached to the first end. The second end is attached to the sewing machine accessory.

In another aspect, the accessory arm is rotatable about the horizontal direction.

In another aspect, the first and second magnetic components are substantially aligned with the horizontal direction.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

FIG. 1 illustrates a perspective view of a sewing machine 100 including a support arm 102 and an accessory arm 104 for positioning a sewing machine accessory 106 in accordance with embodiments of the present disclosure. In this example, the sewing machine accessory 106 is a magnifier. The magnifier may include one or more lenses and a frame to hold the lens(es) for magnifying a workspace, generally designated 108, including material being sewing, a sewing needle, and/or other objects in the workspace 108. In this example, the magnifier has three interchangeable lenses with different magnification. Alternatively, the sewing machine accessory 106 can be a light source or any other suitable accessory for aiding the operator with sewing. A light source may be a light emitting diode (LED), incandescent bulb, or other suitable light source for lighting the work area and/or objects in the workspace 108.

Referring to FIG. 1, the sewing machine 100 includes an upper body 110 and a lower body 112. The workspace 108 and a needle mechanism 114 is generally positioned between the upper body 110 and the lower body 112. A presser foot 116 holds cloth or other material in place beneath it while a needle of the needle mechanism 114 moves upward and downward along a vertical direction (indicated by double arrow 118) for sewing together material as will be understood by those of skill in the art.

As will be described in further detail herein and in accordance with embodiments of the present disclosure, the accessory arm 104 and thereby the sewing machine accessory 106 are removably attached to the support arm 102. Further, the support arm 102 and the accessory arm 104 are configured such that the sewing machine accessory 106 can be positioned or oriented to a user-determined position with respect to the workspace 108. Particularly, a user (or operator) of the sewing machine 100 can attach the accessory arm 104 to the support arm 102 such that the sewing machine accessory 106 is carried or held.

While the sewing machine accessory 106 is carried or held, the user may position the sewing machine accessory 106 to a desired position and/or orientation with respect to the workspace 108. In an example, the sewing machine accessory 106 may be pivoted about a vertical axis (in the direction of arrow 118) and/or pivoted about a horizontal axis (perpendicular to the direction of arrow 118). In another example, the sewing machine accessory 106 may be raised or lowered to a position in the vertical direction and/or moved in the horizontal direction. In the instance of the sewing machine accessory 106 being a magnifier, this functionality enables the magnifier to be oriented as desired magnifying an operator's view of the workspace 108 of the sewing machine 100.

Now turning to FIG. 2A, this figure illustrates a perspective view of the support arm 102 with the accessory arm 104 being detached therefrom. The sewing machine accessory 106 is attached to the accessory arm 104 in this example. The support arm 102 and the accessory arm 104 includes coupling components 200 and 202, respectively. The coupling components 200 and 202 are configured for attachment together. The coupling components 200 and 202 are generally cylindrical in shape but may alternatively be any other suitable shape or size for handling by the user as described herein. In this example, the axes of the coupling components 200 and 202 is generally aligned together along broken line 204 such that they can be attached together by movement of the accessory arm 104 in the direction generally indicated by arrow 206. By movement of the accessory arm 104 in the direction 206, an end 208 of the coupling component 202 enters an opening 210 of the coupling component 200 and fits in an interior 212 defined by an interior surface 214 of the coupling component 200. The end 208 is the portion of the coupling component 202 that is received into the interior 212. The end 208 of the coupling component 202 and the interior surface 214 are generally cylindrical in shape and fits together such that the coupling component 202 can freely pivot or rotate about the axis (represented by broken line 204) with respect to coupling component 200. In this way, the user can rotate the sewing machine accessory 106 as needed for desired positioning.

The interior 212 can extend along a horizontal direction generally parallel with the direction of arrow 206. The interior 212 can define an upper surface and a lower surface (not shown in FIG. 2A). The end 208 of the coupling component 202 can engage the upper surface and the lower surface of the interior 212 for support of the accessory arm 104 in a vertical direction (generally perpendicular to the direction of arrow 206).

Although the upper surface and the lower surface of the interior 212 can hold the end 208 to an extent, additional features may be suitably provided for holding the end 208 in the interior 221. For example, the coupling components 200 and 202 can each have magnetic components that are attracted to each other when the support arm 102 and the accessory arm 104 are attached as shown in FIG. 1. In this example, the end 208 includes magnetic component 216 at its outside. The magnetic component 216 of the accessory arm 104 urges the coupling component 202 towards the coupling component 200 when the first and second coupling components are attached together. This is due to the placement of the magnetic component (not shown) within the interior 212 where the magnetic component is held. In this example, the magnetic component 216 is a metal screw, but it should be understood that the magnetic component may alternatively be a permanent magnet or any other suitable magnetic component that can be attracted to another magnetic component.

A feature can be defined within the interior of the coupling component 200 that stops or resists further insertion of the coupling component 202. At this stopped position, the coupling component 202 can pivot with respect to the coupling component 200. For example, FIG. 2B illustrates a cross-sectional, side view of the support arm 102 with the accessory arm 104 being attached. Referring to FIG. 2B, the coupling component 202 is shown as being inserted into the coupling component 200 to the fullest extent when the magnetic component 216 abuts against a magnetic component 300 of the coupling component 200 after moving in the direction indicated by arrow 206. In this example, the magnetic components 216 and 300 touch to prevent further insertion, but it should be appreciated that the coupling component 200 and/or the coupling component 202 may include additional features for preventing further insertion and for facilitating pivot of the accessory arm 104.

With continuing reference to FIG. 2B, the interior 212 defines an upper surface and a lower surface (not shown in FIG. 2A). The end 208 of the coupling component 202 can engage an upper surface 218 and a lower surface 220 of the interior 212 for support of the accessory arm 104 in a vertical direction (generally perpendicular to the direction of arrow 206). As a result, the accessory arm 104 can be held in place within the support arm 102 while also permitting pivot of the accessory arm 104. Also in this position, the magnetic components 216 and 300 can hold the coupling components 200 and 202 in place along the horizontal direction (i.e., perpendicular to the direction of arrow 206). A user may release or remove the accessory arm 104 and also the sewing accessory 106 from this position by pulling the accessory arm 104 and/or the sewing accessory 106 in the direction opposite the direction of arrow 206 such that the force of attraction between the magnetic components 216 and 300 is overcome.

FIG. 3 illustrates an exploded, perspective view of the support arm 102 with its coupling component's 200 magnetic component 300 being positioned outside of the interior 212 for purpose of illustration. The magnetic component 300 of the coupling component 200 is depicted outside of the interior 212 to show its size and shape. In this example, the magnetic component 300 is a permanent magnet having a cylindrical shape, but it should be appreciated that the magnetic component 300 may be any suitable type, size, and shape for urging the magnetic component 300 of the accessory arm 104 towards it when the support arm 102 and the accessory arm 104 are attached together. Also, the magnetic component 300 may be suitably attached and positioned within the interior 212.

FIG. 4 illustrates an exploded, perspective view of the accessory arm 104 with the coupling component generally designed 202. Referring to FIG. 4, the magnetic component 216 is a screw having a head component 400 and a threaded component 402 attached thereto. The magnetic component (or screw in this example) 216 can be attached to the other main portion 404 of the coupling component 404 by screwing the threaded component 402 to a nut 406. More particularly, the nut 406 can be inserted into a slot 408 defined in a side of the main portion 404. By inserting the nut 406 into the slot a sufficient distance, a center of the nut 406 can be aligned with an axis of the main portion 404 indicated by broken line 410. An aperture 412 facing the screw extends from the end of the main portion 404 to the center of the nut 406 (when placed appropriately in the slot 408) such that the threaded component 402 can be screwed into the nut 406, thereby attaching the magnetic component 216 to the main portion 404. It is noted that in this example the head component 400 can be attached to the magnetic component 300 when the support arm 102 and accessory arm 104 are attached.

An O-ring 414 or other suitable washer 414 can be used to more securely attached the magnetic component 216 to the main portion 404. Particularly, when attaching the magnetic portion 212 to the main portion 404, the threaded component 402 may be inserted through the O-ring 414, and then inserted into the aperture 412 and screwed to the nut 406. As shown in this example, magnetic components are substantially aligned with the horizontal direction, which is parallel with line 410.

As described, the sewing accessory 106 can be freely and steplessly rotated 360° about the axis represented by broken line 410. In other examples, the sewing accessory 106 may only be partially rotatable. The end 418 is substantially cylindrical in shape to facilitate rotation about the horizontal direction, but it should be appreciated that this portion may have any other suitable shape for rotation and/or include any other suitable mechanism for permitting rotation in any direction. Further, it is noted that the attachment by the screw along with the O-ring 414 can created a friction for resisting rotation and for holding the sewing accessory 106 at a point of rotation once set by the user.

In the example of FIG. 4, the main portion 404 is permanently attached to the sewing accessory 106 at an end 416. Alternatively, the main portion 404 may be removably attached to the sewing accessory 106. The end 416 opposes end 418 where the aperture 412 is defined. The accessory arm 202 extends along a substantially horizontal direction (parallel with line 410).

FIGS. 5A and 5B illustrate perspective views of the support arm 102 in a detached position and an attached position, respectively, with respect to an underside of a sewing machine in accordance with embodiments of the present disclosure. Referring to FIGS. 5A and 5B, an upper body of a sewing machine (e.g., upper body 110 shown in FIG. 1) can include an attachment mechanism 500 (not visible in FIG. 1) that extends downward into the sewing workspace (e.g., workspace 108 shown in FIG. 1). The support arm 102 can be removably attached to the attachment mechanism 500. The support arm 102 may be removed from its attachment to the attachment mechanism 500 in order to make more available in the workspace. It is noted that FIGS. 5A and 5B do not show an accessory arm being attached to the support arm 102 for ease of illustration.

Now turning to FIG. 5A, the vertical direction is indicated by double arrow 118. The support arm 102 includes an upper end 502 and a lower end 504. The support arm 102 extends along a substantially vertical direction (e.g., direction of arrow 118). The upper end 502 is attachable to the attachment mechanism 500 at the underside of the sewing machine. The coupling component 200 is attached to the lower end 504. For example, the coupling component 200 can include a substantially planar component 506 for attachment to the lower end 504.

For attaching to the attachment mechanism 500, the upper end 502 includes a notch 508 defined in its side. The upper end 502 also defines a tapered portion 513. To attach the support arm 102 to the attachment mechanism 500, the support arm 102 is moved in an upward direction. As shown, the part of the support arm 102 extending between ends 502 and 504 defines an axis (represented by broken line 510) aligned with an interior (not shown) of the attachment portion 500. The interior of the attachment portion 500 has an opening, generally designated 512, for receiving the upper end 502 of the support arm 102. From this position of alignment, the support arm 102 can be moved directly upward into the opening 512 until it engages and attaches to the attachment portion 500. FIG. 5B shows the position of the support arm 102 at the point of engagement and attachment to the attachment portion 500.

To attach to the attachment portion 500, the notch 511 fits to a feature 514 of a resilient member 516 that fits to the notch 511 for holding to the end 502 of the support arm 102. When being moved upward, the tapered portion 513 facilitates movement past the feature 514. Then once the notch 511 reaches the feature 514, the resilient member 516 causes the feature 514 to hold to the notch 511. The resilient member 516 can be made of metal or any other resilient type of material for forcing the feature 514 at its end 518 inward to hold onto the notch 511. The resilient member 516 can be affixed and held to the attachment mechanism 500 by a screw 522. It is noted that this is but one example of holding the support arm 102 to the underside of a sewing machine, but it is envisioned that other mechanism may be used for such functionality.

In accordance with embodiments, the support arm 102 is rotatable about the vertical direction. Particularly, in this example, the support arm 102 is fully rotatable 360° about the axis represented by broken line 510. In other examples, the support arm 102 may only be partially rotatable. The portion between ends 502 and 504 is cylindrical in shape to facilitate rotation about the vertical direction, but it should be appreciated that this portion may have any other suitable shape for rotation and/or include any other suitable mechanism for permitting rotation in any direction.

By rotation in this manner, the support arm 102 may be rotated to a desired position by the user. For example, in the case of a magnifier as the accessory, the magnifier can be better positioned for viewing the workspace. In another example, the support arm 102 can be rotated to move the accessory arm and accessory to a position of storage when not in use, as shown in FIG. 5B where it is stowed under a component 524 of the underside of a sewing machine.

As an example, the presently disclosed subject matter can be utilized in the case of a magnifier accessory for enlarging a view of a sewing area so that the user has a better vision when working. For example, the user can better see a needle when threading or more accurately sew material. Further, for example, it allows the user to have both hands free while working, because the sewing accessory is held by the support arm and the accessory arm while in position for use.

In another example, the sewing accessory of the presently disclosed subject matter can be easily attached to the sewing machine and positioned by only one hand while the other is free. Further, the sewing accessory can advantageously be attached without any tools. Also, for example, the sewing accessory can be moved to a position of storage with one hand due to it being fully rotatable on 2 axes.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. Apparatus for positioning a sewing machine accessory, the apparatus comprising:

a support arm configured for attachment to a sewing machine and comprising a first coupling component, wherein the first coupling component comprises a first magnetic component, and wherein the first coupling component is positioned in a workspace of the sewing machine when the support arm is attached to the sewing machine; and an accessory arm configured for attachment of a sewing machine accessory and comprising a second coupling component, wherein the first coupling component and the second coupling component are configured for attachment together, wherein the second coupling component comprises a second magnetic component that is attracted to the first magnetic component for urging the second coupling component towards the first coupling component when the first and second coupling components are attached together, and wherein the first and second coupling components are configured to position the sewing machine accessory to a user-determined position within the workspace of the sewing machine when the first and second coupling components are attached together.

2. The apparatus of claim 1, wherein the sewing machine accessory comprises a magnifier or a light source.

3. The apparatus of claim 1, wherein the sewing machine accessory comprises a magnifier, and wherein the first and second coupling components are configured to position and orient the magnifier for magnifying an operator's view of a workspace of the sewing machine.

4. The apparatus of claim 1, wherein the second coupling component is rotatable with respect to the first coupling component when the first and second components are attached together.

5. The apparatus of claim 1, wherein the first coupling component defines an interior and opening for receipt of a portion of the second coupling component.

6. The apparatus of claim 5, wherein the first magnetic component is held within the interior, and wherein the second magnetic component is attached to the portion of the second coupling component such that the second magnetic component is positioned within the interior when the first and second coupling components are attached together.

7. The apparatus of claim 5, wherein the interior extends along a substantially horizontal direction, wherein the interior defines an upper surface and a lower surface, wherein the portion of the second coupling component engages the upper surface and the lower surface for support of the accessory arm in a vertical direction.

8. The apparatus of claim 1, wherein the support arm comprises an upper end and a lower end, wherein the support arm extends along a substantially vertical direction, wherein the upper end is attachable to an underside of the sewing machine, and wherein the first coupling component is attached to the lower end.

9. The apparatus of claim 8, wherein the support arm is rotatable about the vertical direction.

10. The apparatus of claim 1, wherein the accessory arm comprises a first end and a second end, wherein the accessory arm extends along a substantially horizontal direction, wherein the second coupling component is attached to the first end, and wherein the second end is attached to the sewing machine accessory.

11. The apparatus of claim 10, wherein the accessory arm is rotatable about the horizontal direction.

12. The apparatus of claim 11, wherein the first and second magnetic components are substantially aligned with the horizontal direction.

13. A sewing machine comprising:

an upper body comprising a needle mechanism;

a lower body comprising a workspace positioned under the needle mechanism;

a support arm attached to the upper body and comprising a first coupling component, wherein the first coupling component comprises a first magnetic component, and wherein the first coupling component is positioned in a workspace of the sewing machine when the support arm is attached to the sewing machine; and an accessory arm attached to a sewing machine accessory and comprising a second coupling component, wherein the first coupling component and the second coupling component are configured for attachment together, wherein the second coupling component comprises a second magnetic component that is attracted to the first magnetic component for urging the second coupling component towards the first coupling component when the first and second coupling components are attached together, and wherein the first and second coupling components are configured to position the sewing machine accessory to a user-determined position within the workspace of the sewing machine with respect to the workspace when the first and second coupling components are attached together.

14. The sewing machine of claim 13, wherein the sewing machine accessory comprises a magnifier or a light source.

15. The sewing machine of claim 13, wherein the sewing machine accessory comprises a magnifier, and wherein the first and second coupling components are configured to position and orient the magnifier for magnifying an operator's view of a workspace of the sewing machine.

16. The sewing machine of claim 13, wherein the second coupling component is rotatable with respect to the first coupling component when the first and second components are attached together.

17. The sewing machine of claim 13, wherein the first coupling component defines an interior and opening for receipt of a portion of the second coupling component.

18. The sewing machine of claim 17, wherein the first magnetic component is held within the interior, and wherein the second magnetic component is attached to the portion of the second coupling component such that the second magnetic component is positioned within the interior when the first and second coupling components are attached together.

19. The sewing machine of claim 17, wherein the interior extends along a substantially horizontal direction, wherein the interior defines an upper surface and a lower surface, wherein the portion of the second coupling component engages the upper surface and the lower surface for support of the accessory arm in a vertical direction.

20. The sewing machine of claim 13, wherein the support arm comprises an upper end and a lower end, wherein the support arm extends along a substantially vertical direction, wherein the upper end is attachable to an underside of the sewing machine, and wherein the first coupling component is attached to the lower end.

21. The sewing machine of claim 20, wherein the support arm is rotatable about the vertical direction.

22. The sewing machine of claim 13, wherein the accessory arm comprises a first end and a second end, wherein the accessory arm extends along a substantially horizontal direction, wherein the second coupling component is attached to the first end, and wherein the second end is attached to the sewing machine accessory.

23. The sewing machine of claim 22, wherein the accessory arm is rotatable about the horizontal direction.

24. The sewing machine of claim 23, wherein the first and second magnetic components are substantially aligned with the horizontal direction.

* * * * *